US005163587A

United States Patent [19]

Apps et al.

[11] Patent Number: 5,163,587

[45] Date of Patent: Nov. 17, 1992

[54] SYRUP DELIVERY SYSTEM

[75] Inventors: William P. Apps, Anaheim; Arne Lang-Ree, Manhattan Beach, both of Calif.; W. Joseph Yelder, Peeksville, N.Y.

[73] Assignees: Rehrig-Pacific Co., Los Angeles, Calif.; Pepsi-Cola Company, Somers, N.Y.

[21] Appl. No.: 869,852

[22] Filed: Apr. 16, 1992

Related U.S. Application Data

[63] Continuation of Ser. No. 493,728, Mar. 14, 1990, abandoned, which is a continuation-in-part of Ser. No. 448,580, Dec. 11, 1989, Pat. No. D. 320,298.

[51] Int. Cl.[5] ..... B65D 35/56

[52] U.S. Cl. ..... 222/105; 206/505; 220/403; 222/132; 222/143; 222/145; 222/185

[58] Field of Search ..... 222/105, 143, 132, 145, 222/185, 183, 386.5; 206/505, 507; 220/403

[56] References Cited

U.S. PATENT DOCUMENTS

| | | | |
|---|---|---|---|
| D. 197,311 | 1/1964 | Spaak | D34/40 |
| D. 252,172 | 6/1979 | Carroll et al. | D3/67 |
| 3,265,254 | 8/1966 | Carter et al. | 222/143 X |
| 3,368,721 | 2/1968 | Wiskochil | 222/183 |
| 3,371,824 | 3/1968 | Goss | 222/183 |
| 3,379,339 | 4/1968 | Asenbauer . | |
| 3,421,656 | 1/1969 | Asenbauer . | |
| 3,447,715 | 6/1969 | Beney | 220/97 |
| 3,628,684 | 12/1971 | Sere | 220/21 |
| 3,642,168 | 2/1972 | Wiley, Jr. et al. | 206/518 |
| 3,773,213 | 11/1973 | Fredrick | 220/97 |
| 3,830,406 | 8/1974 | Robb | 222/143 |
| 3,837,533 | 9/1974 | Splan | 222/185 X |
| 3,840,115 | 10/1974 | Ladewig | 206/506 |
| 3,940,018 | 2/1976 | Scholle | 222/185 X |
| 3,964,636 | 6/1976 | Rehrig | 220/306 |
| 4,011,948 | 3/1977 | Rehrig et al. | 206/507 |
| 4,189,052 | 2/1980 | Carroll et al. | 206/507 |
| 4,205,749 | 6/1980 | Carroll et al. | 206/507 |
| 4,557,406 | 12/1985 | Olinger et al. | 222/564 |
| 4,645,122 | 2/1987 | Nederveld | 229/45 |
| 4,823,955 | 4/1989 | Apps | 206/506 |
| 5,029,734 | 7/1991 | Nichols | 222/105 |

OTHER PUBLICATIONS

Lewisystems Jan. 1983, p. 23, Bulk Containers, top of the page.

Lewisystems, Jan. 1983, Back page, bottom right container.

Liqui-Box, Liqui-Box Corporation.

*Primary Examiner*—Donald T. Hajec

*Attorney, Agent, or Firm*—Banner, Birch, McKie & Beckett

[57] ABSTRACT

A syrup delivery system including a plurality of open-top, sturdy plastic containers and syrup bags. Each bag is positionable in a separate container with the bag spigot thereof extending accessible out through a container end opening. The open gridwork bottom of the container slopes to the container end opening so that the syrup in the bag can drain more completely out through the spigot with the container supported on a flat level surface. The containers have top locking posts, bottom stacking feet, and undulating-like sides. With the containers aligned so that their end openings face the same direction, the containers can be stacked one on top of the other with the posts of the bottom container engaging up into the feet of the top container. To unstack, the top container is tilted forward, the posts and feet thereby disengage, and the tilted top container easily slid down the sloping front lip of the lower container. To nest the containers, the top container is rotated 180 degress about a vertical axis and the containers, due to their undulating sides, nest together in a relatively compact two-to-one nesting ratio. In the nested position the posts of the bottom container extend up into openings in horizontal support surfaces positioned mid-way up the sides of the top container.

65 Claims, 12 Drawing Sheets

SYRUP DELIVERY SYSTEM

BACKGROUND OF THE INVENTION

This is a continuation of copending application Ser. No. 07/493,728, filed Mar. 14, 1990, now abandoned, which is a continuation-in-part of copending application Ser. No. 07/448,580, filed Dec. 11, 1989, now U.S. Pat. No. Des. 320,298.

The present invention relates to systems for delivering beverage syrups to fountain service customers. It further relates to boxes, containers or cases which when in a first relative position are stackable on top of one another and when in a second position are nestable in one another.

Today, most beverage syrups or post-mixes are shipped from the bottling plant to the fountain service customer in disposable, five gallon, multi-layered bags, packed in eight-inch by twelve-inch by sixteen-inch corrugated disposable boxes. The customer places the boxes on a special rack which tilts them for more thorough drainage. (On occasion, the racks are not used.) He tears open perforated areas on the boxes to expose spigots built into the bags and connects a line to the spigots to pump out the post-mix. A number of these bags can be hooked up in series and drained simultaneously. An example of this rack-box system is that available from Rudbar, Inc. of Mt. Vernon, N.Y.

There are many problems with these systems, however, and most of them derive from the corrugated box element. Not only are corrugated boxes becoming increasingly more expensive, they are generally not reusable. They must be disposed of by the customer, and these customers are often fast food franchisees who are under pressure to reduce the volume of their waste. These boxes occasionally collapse under static loads when palletized, and this collapsing problem is aggravated when the box becomes wet due to a leaking bag, inclement weather or wet environment. These boxes are also unsanitary since they can retain dirt and germs and attract bugs. The box forming machinery which folds and glues the boxes has also experienced problems in the past.

SUMMARY OF THE INVENTION

Directed to remedying these problems, a novel syrup delivery system is provided herein using neither racks nor corrugated boxes. Rather, it comprises a plurality of sturdy, reusable open-top boxes, which are stackable when full and nestable when empty. Each of the boxes has a working aperture at one end thereof defining a spigot end and out through which the spigot of a syrup bag held in the box is accessible. The inside bottom of the box is sloped towards the spigot end to aid drainage from the bag out its spigot. The boxes stack securely one on top of the other in a self-supporting arrangement and with their spigot ends facing the same direction. The bags can then be easily hooked in series since all of the spigots are on the same side of the stack, and racks are thus no longer needed. The top of the front spigot end of the box is sloped down to ease manual unstacking as when the stacked full boxes are to be unloaded off of a delivery truck. The delivery person need only tilt the top case or box forward slightly to unlock the locking feet and slide the box forward down the top lip of the box beneath it. When the boxes are empty and rotated so that their spigot ends are facing in opposite directions, they can nest one within the other with a relatively deep, two-to-one nesting ratio. This two-to-one nesting ratio permits each additional box added to a stack of nested boxes to add only about one half its height to the nested stack. In other words, they conveniently stack with like ends facing the same direction and nest with like ends facing in opposite directions.

Other objects and advantages of the present invention will become more apparent to those persons having ordinary skill in the art to which the present invention pertains from the foregoing description taken in conjunction with accompanying drawings.

DETAILED DESCRIPTION OF PREFERRED EMBODIMENTS OF THE INVENTION

Figure 1:
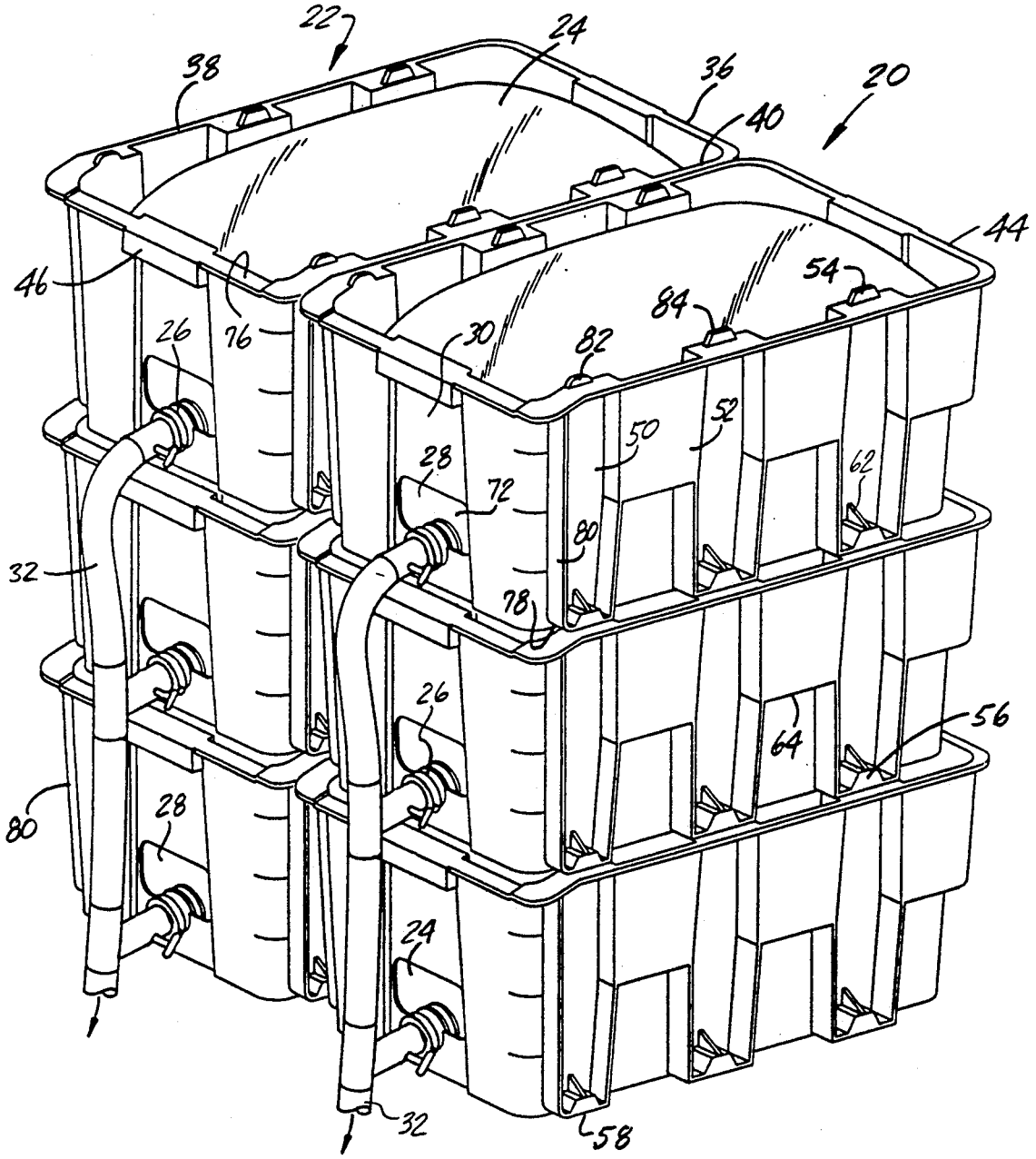
FIG. 1 is a perspective view of a syrup delivery system of the present invention.
Figure 6:
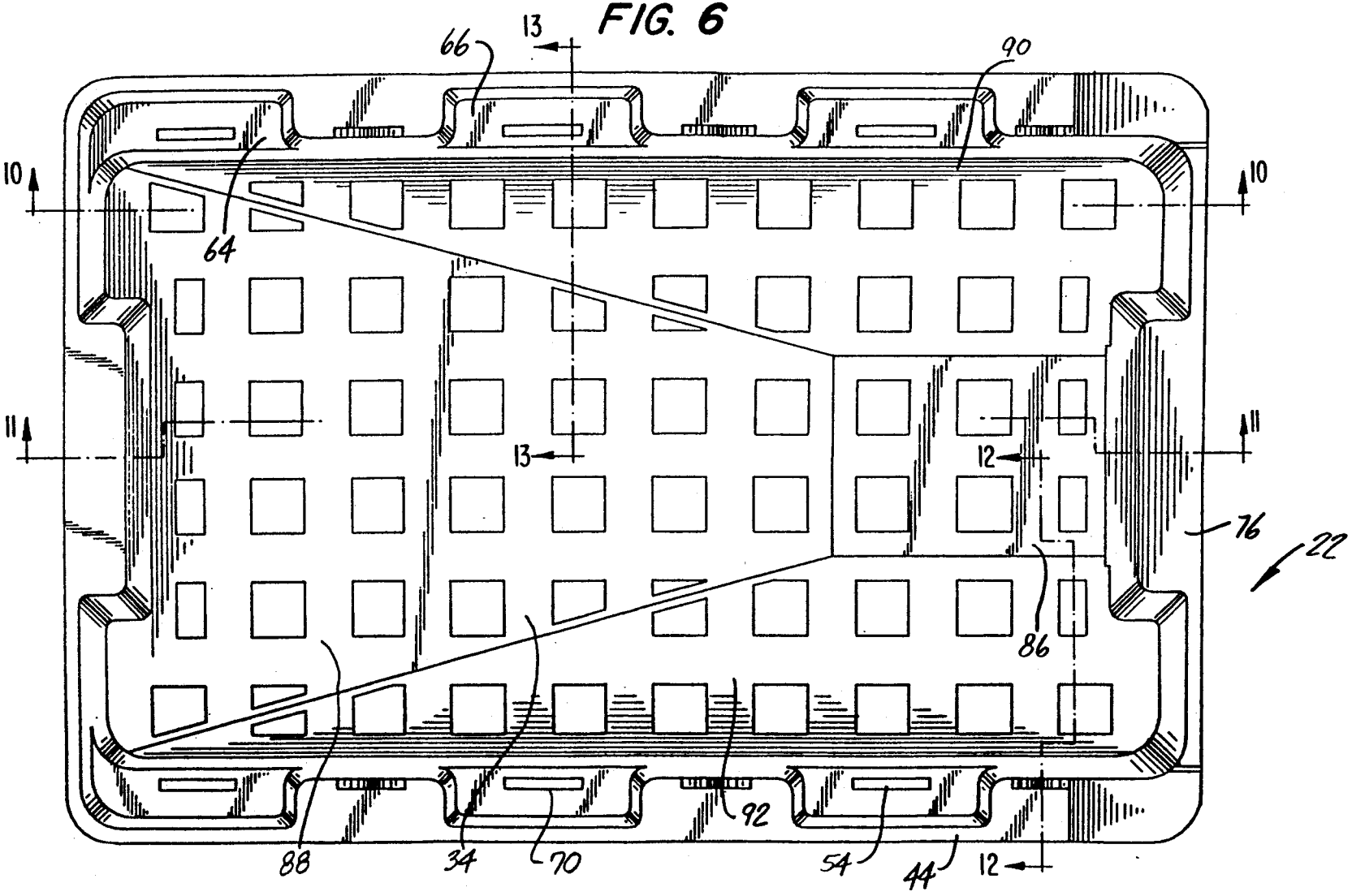
FIG. 6 is a top plan view thereof.
Figure 7:
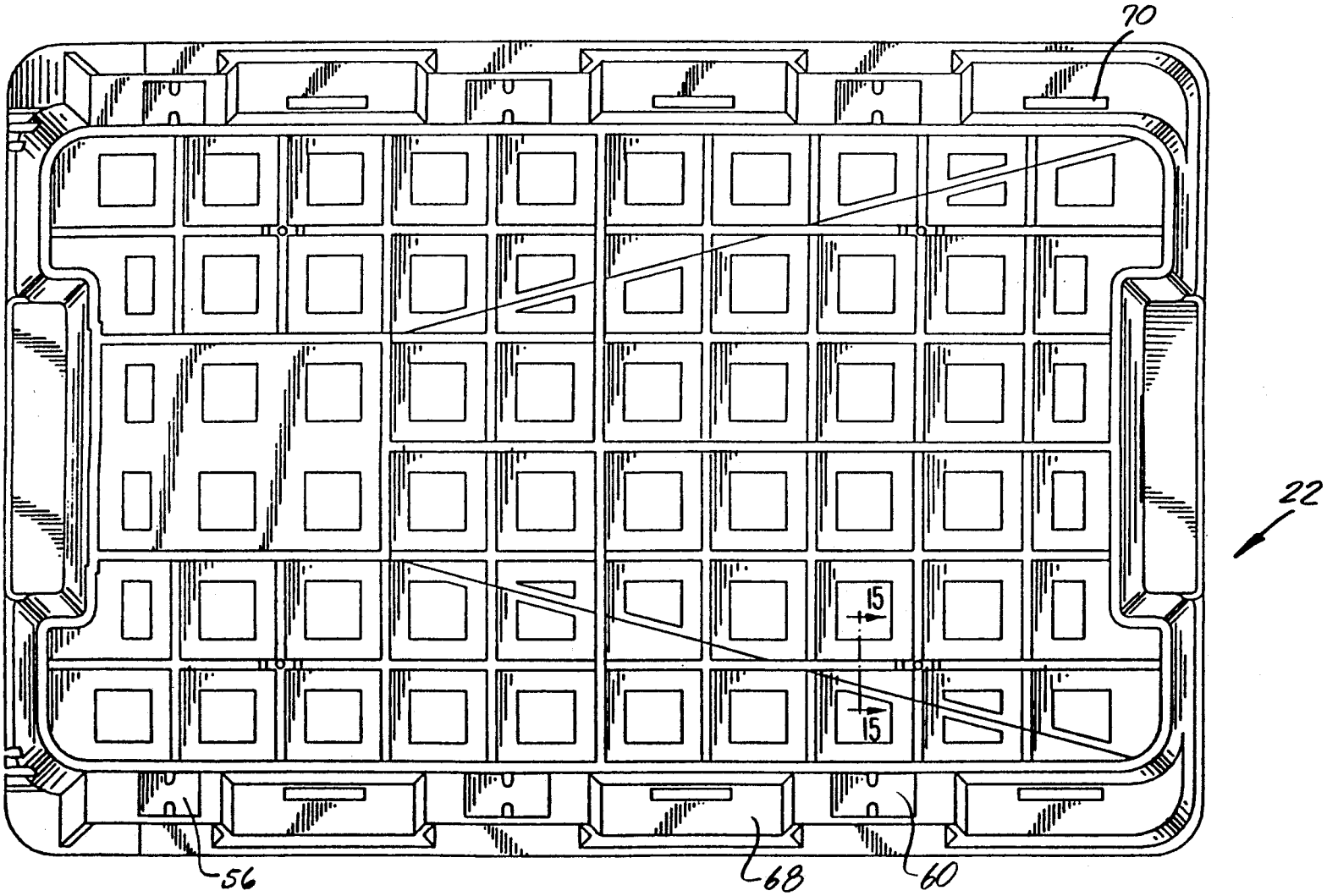
FIG. 7 is a bottom plan view thereof.
Figure 8:
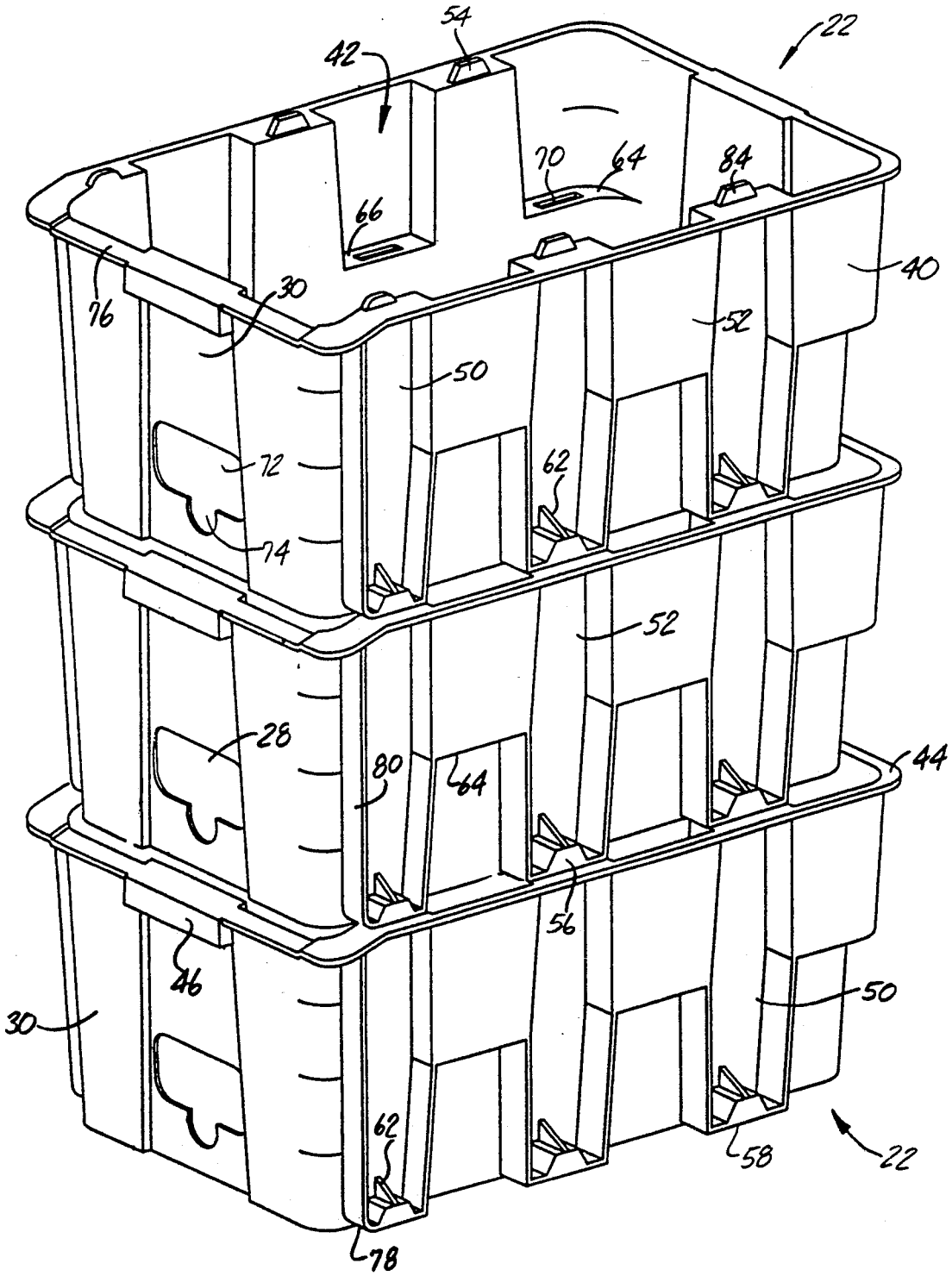
FIG. 8 is a perspective view showing the container of FIG. 2 in a stacked relation with other similar containers.
Figure 9:
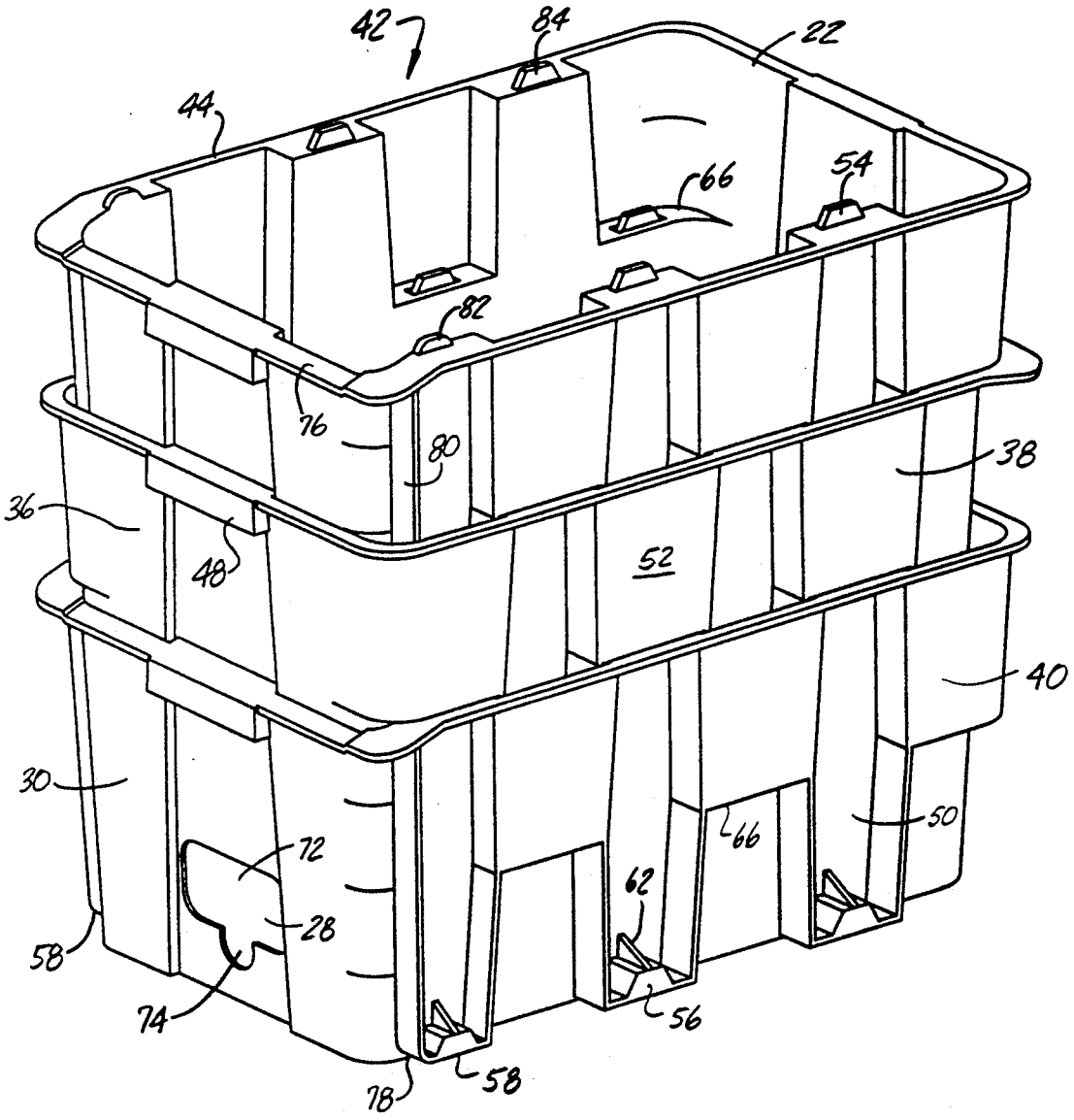
FIG. 9 is a view similar to that of FIG. 8 showing the containers in a nested relation.
Figure 10:
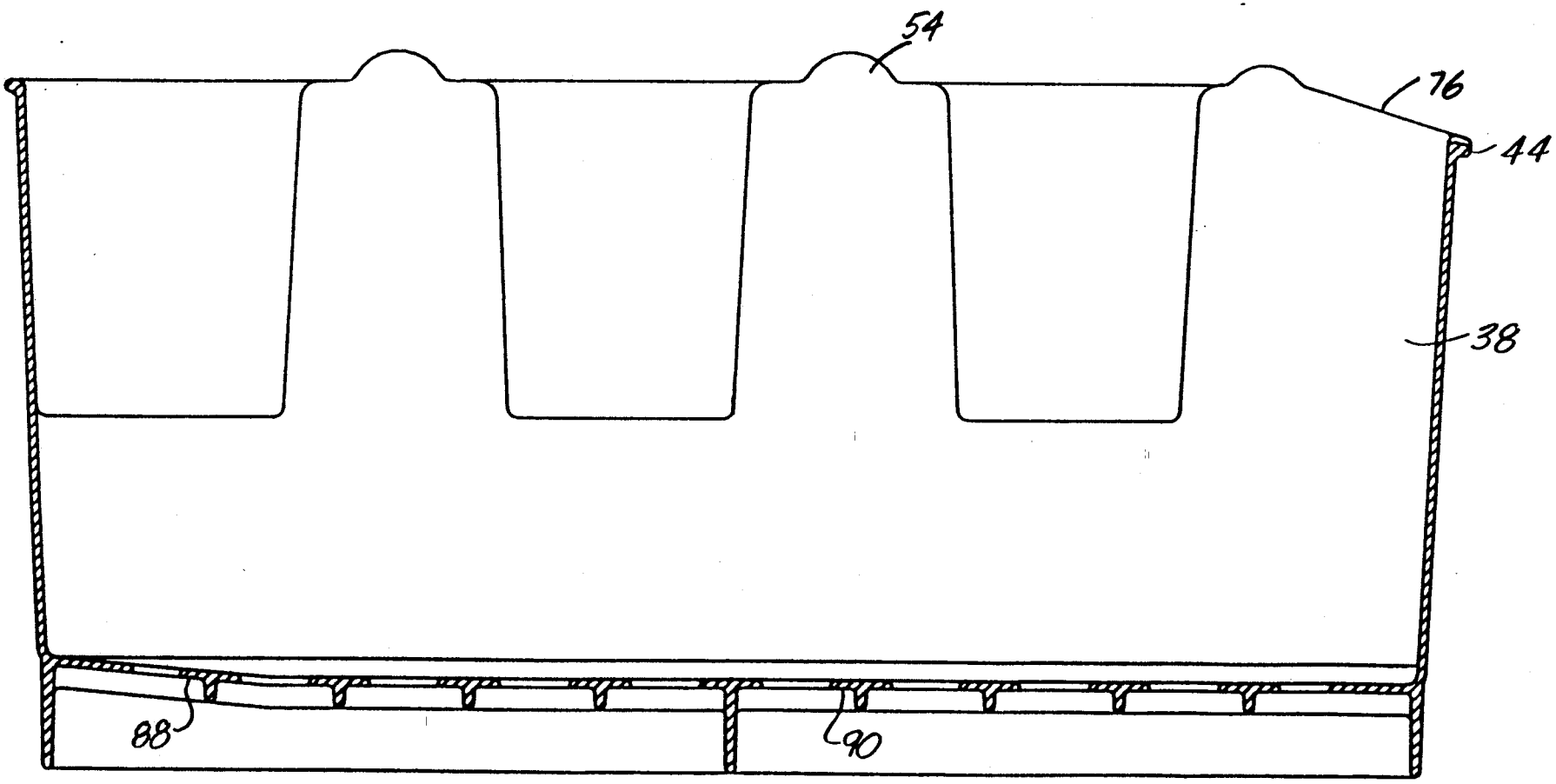
FIG. 10 is a cross-sectional view taken along line 10—10 of FIG. 6.

Referring to FIG. 1, a syrup delivery system of the present invention is illustrated generally at 20. The system 20 basically comprises a plurality of similar or identical cases, containers or boxes shown generally at 22, a syrup bag 24 in each of the boxes and having a spigot 26 accessible through an aperture 28 at a front end 30 of the box, and hosing 32 connecting the spigots 26 in series. The box 22 has a unique construction such that when oriented with like ends facing the same direction, such as shown in FIGS. 1 and 8, the boxes stack securely when on top of the other and interlock with a stacking post arrangement, described in greater detail later, to prevent slipping between the stacked boxes. However, when the boxes 22 are rotated such that vertically adjacent boxes are facing in opposite directions and the boxes are empty or nearly so, they will nest one within the other, as shown in FIG. 9, in a compact arrangement for easy transport. The bottom floor 34 of the box 22 slopes down towards the working aperture end 30 of the box, as shown for example in FIG. 11, to help the syrup bags 24 supported thereon to more completely and quickly drain out through their spigots 26. The open gridwork design of the bottom floor 34, as depicted in FIGS. 6 and 7, facilitates the rapid washing of the box 22 and the drainage of the wash water out therefrom without having to turn the box over.

FIGS. 2–4A, 5–7 and 10–15 show in isolation various views and sections of a box 22 of this invention. This box 22 is integrally molded of a suitable plastic, such as high-density polyethylene. It includes the front end wall 30, a rear end wall 36 (see FIG. 5), a pair of opposing side walls 38, 40, and the bottom floor 34 secured therein, and it has an open top shown generally at 42. An outwardly projecting rim or lip 44 is provided along the top surfaces of the side and end walls. Upwardly recessed hand grips 46, 48 formed with the rim 44 centrally at the tops of both of the end walls 30, 36 assist in lifting and manipulating the box 22 or a stack of them. Both of the side walls 38, 40 are formed with serially arranged first and second panels 50, 52 forming an undulating-like cross-section (see FIG. 13) through at least the upper halves thereof. There are the same number of first and second panels 50, 52 on each of the sides, the reasons for which will become apparent.

At the top of the first panels 50 and projecting up from the lip 44 are locking posts 54. At the bottoms of each of the first panels 50 are stacking feet 56 having bottom surfaces 58 projecting generally out from adjacent side wall structure and positioned a slight distance spaced above the bottom surface of the box 22 as can be seen, for example, in FIG. 3, so they are less likely to be impacted and damaged. Recesses or slots 60 are formed up through the bottom surface 58 of the stacking feet 56 as can be seen in FIG. 7, for example. Thus, with a pair of boxes 22 aligned with their working apertures 28 facing the same direction and one on top of the other, the posts 54 of the bottom box will be aligned with the slots 60 of the upper box and will fit up thereinto to lock the stacked boxes together, as is shown in FIGS. 1 and 8, to prevent sliding between them. Thus, each postfoot combination can be viewed as a modular unit. In this stacked arrangement, all of the working apertures 28 face in the same direction so that the spigots 26 can be connected in series with the hosing 32 as shown in FIG. 1. Triangular bracing structures 62 brace the top of the stacking feet 56 against the side wall structure.

Figure 14:
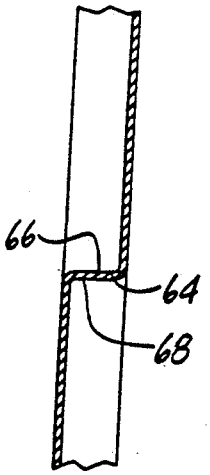
FIG. 14 is a cross-sectional view taken along line 14—14 of FIG. 11.
Figure 15:
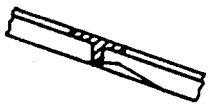
FIG. 15 is a cross-sectional view taken along line 15—15 of FIG. 7.

The second panels 52 have support structures 64 extending horizontally about mid-way along their height and shown in cross-section in FIG. 14. The second panels 52 are stepped down and into the box 22 such that the top surfaces 66 of the support structures 64 are positioned inside of the box 22 and the lower surfaces 68 (FIG. 7) are positioned on the outside. Thus with the top (or lower) box rotated end to end (180° about a vertical axis) such that the working apertures 28 of the two boxes are facing in opposite directions, the top box can nest within the lower box, as shown in FIG. 9. The locking posts 54 of the lower box then will fit up into the slots 70 through the top support surface 66.

Figure 4A:
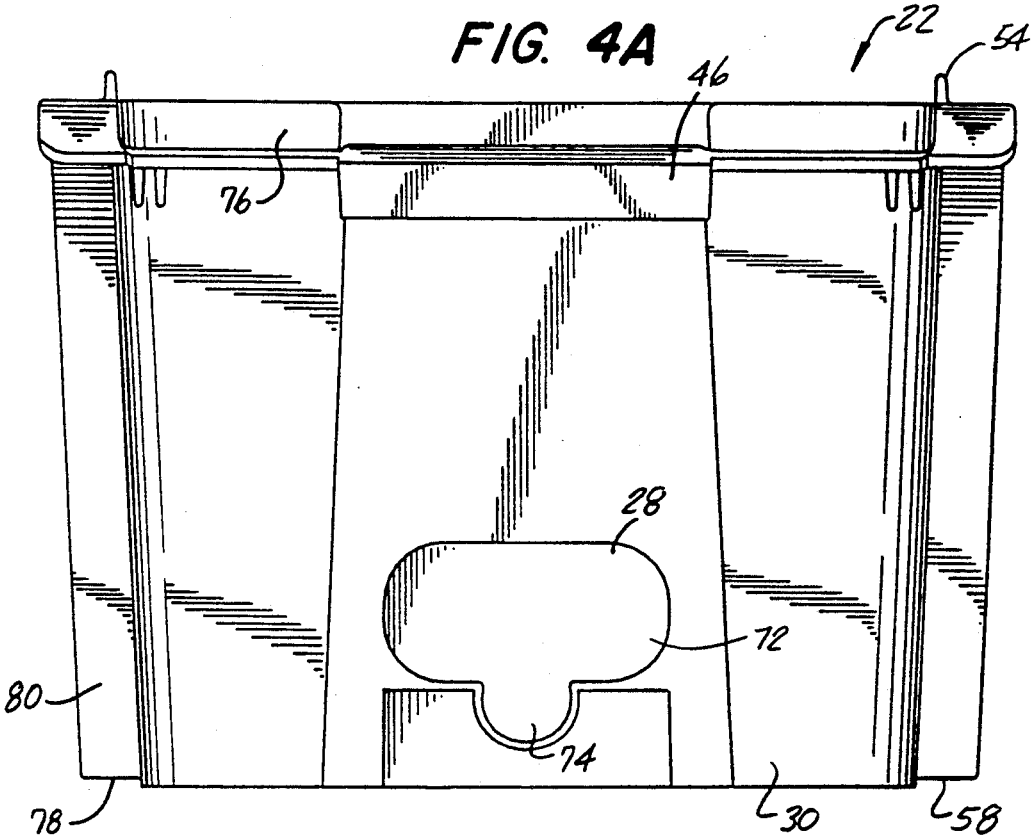
FIG. 4A is a front end view of the container of FIG. 2.
Figure 5:
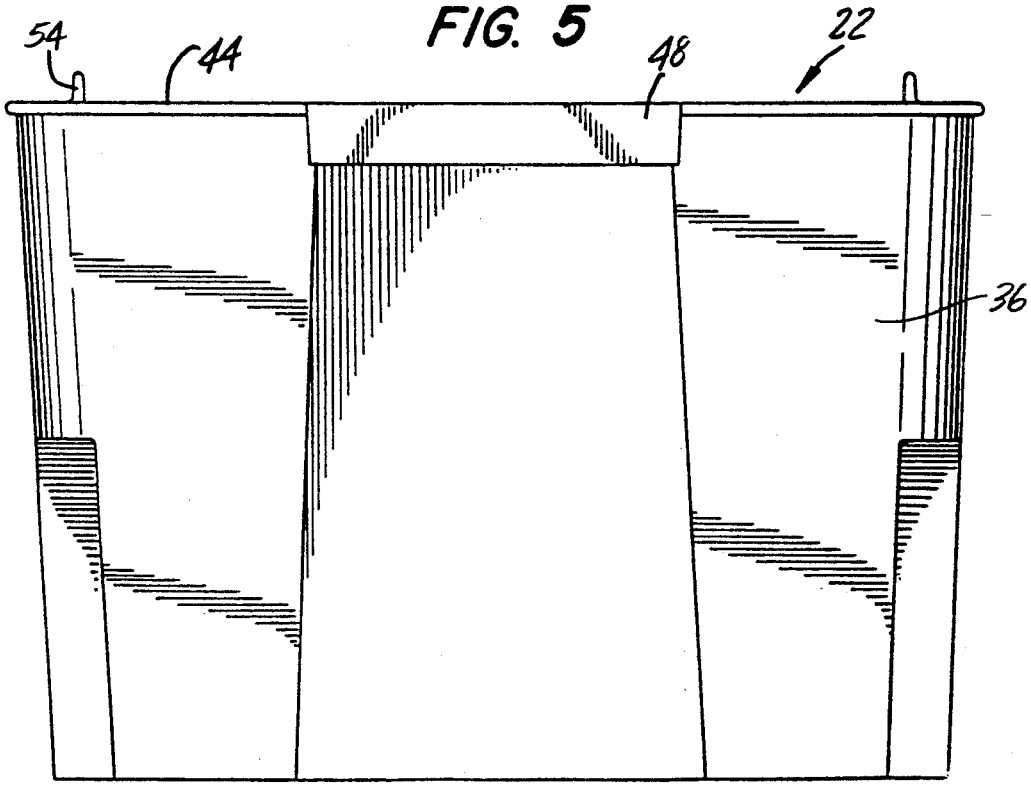
FIG. 5 is a rear end view of the container of FIG. 2.
Figure 4B:
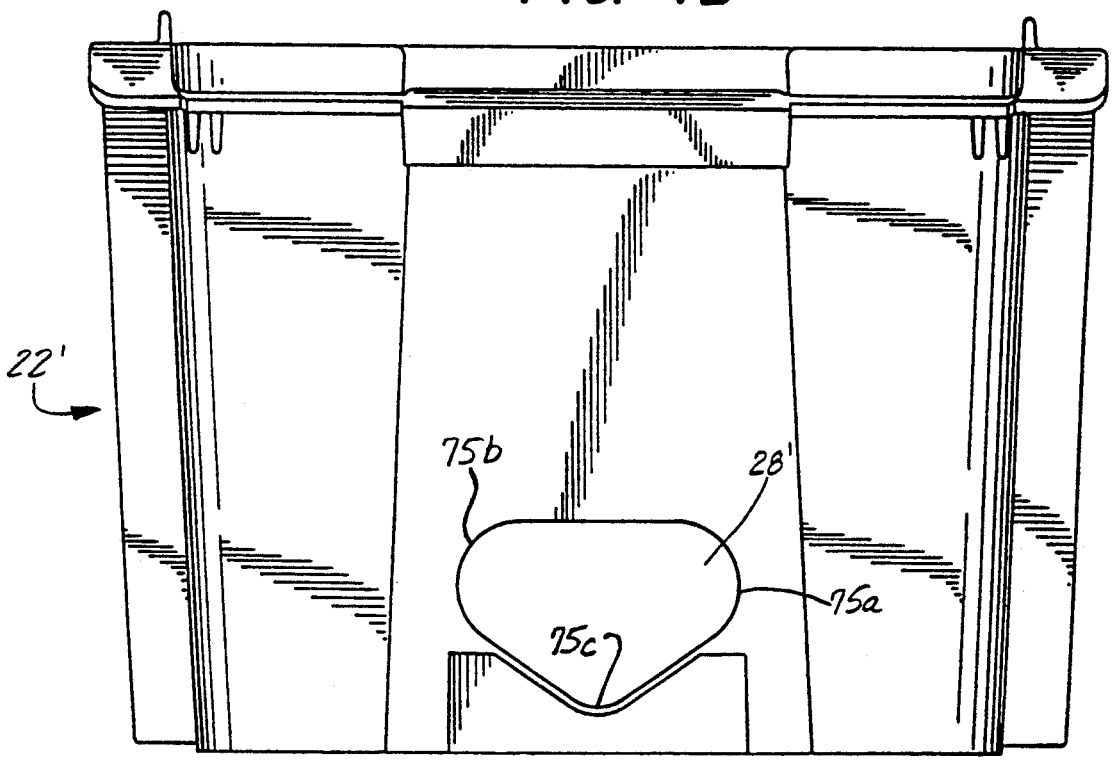
FIG. 4B is a view similar to that of FIG. 4A of an alternative container of the present invention.

The working aperture 28 is formed with first and second openings 72, 74 wherein the first opening 72 is larger, generally rectangularly shaped and has rounded corners and the second opening 74 communicates with the first and defines an upwardly-disposed semi-circle, as shown in FIG. 4A for example. Thus, the spigot 26 can be positioned out through the first opening 72 when the bag 24 is dropped into the box 22 and rest down into the second opening 74, as depicted in FIG. 1. FIG. 4B shows a front end view of an alternative box 22' of the present invention. The basic difference between box 22' and box 22 is the configurations of the working apertures 28' and 28, respectively. Aperture 28', as shown in FIG. 4B, has a downwardly-pointed triangular shape with rounded corners. Corners **75*a* and 75*b* can have radii of 0.75 inch, while corner 75*c*** can have a 0.55 inch radius, for example.

Figure 2:
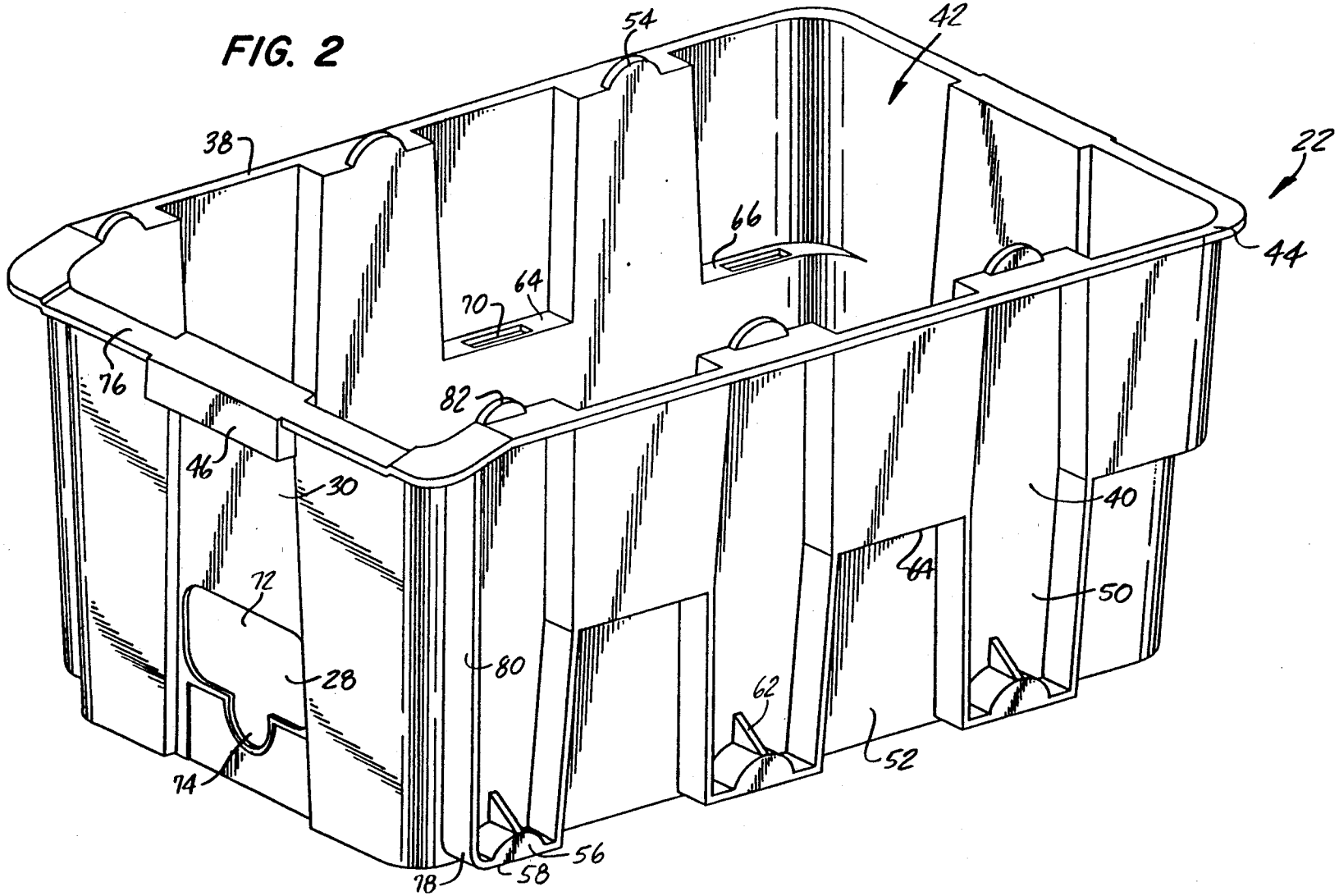
FIG. 2 is an enlarged perspective view of a container of the system of FIG. 1, shown in isolation.
Figure 3:
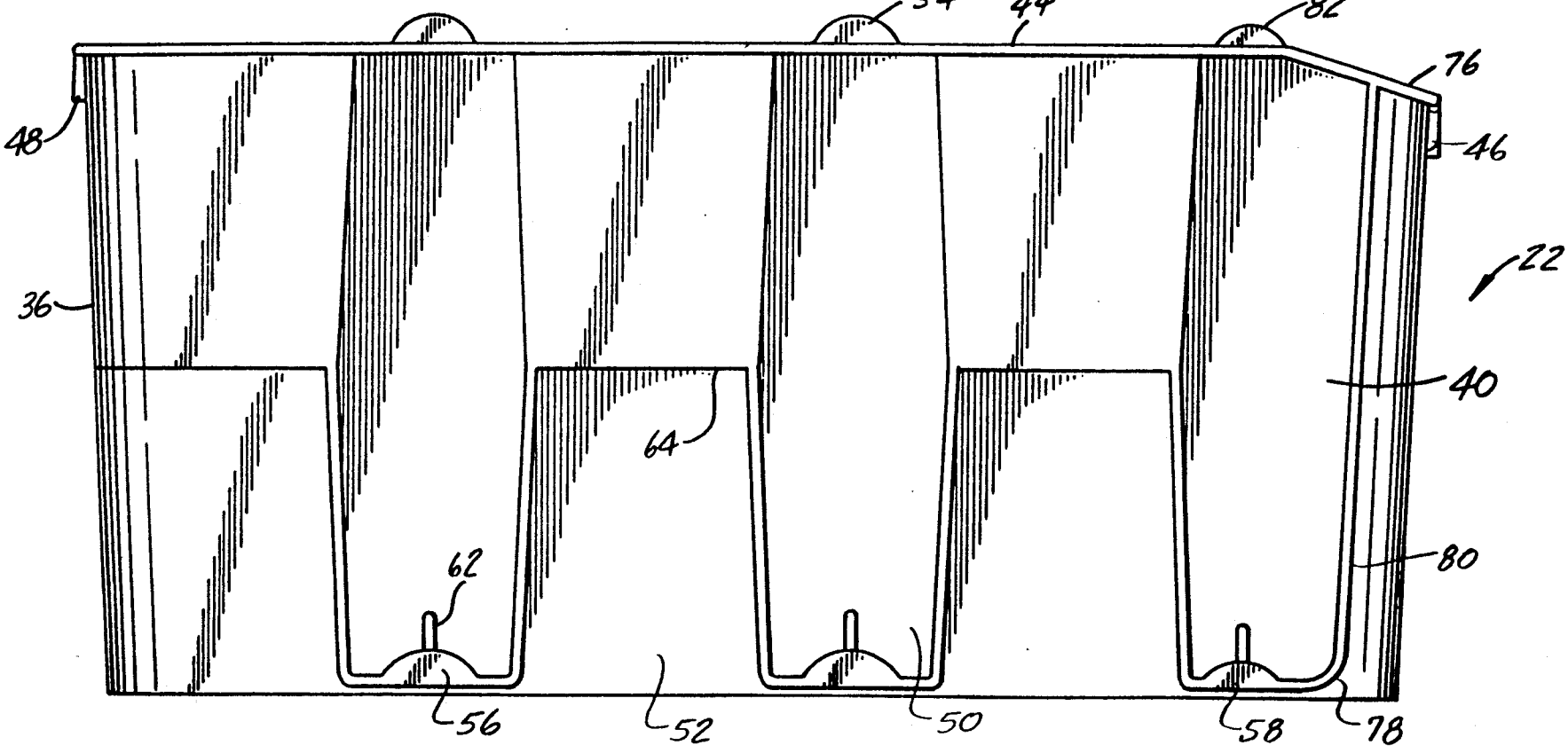
FIG. 3 is a side elevational view of the container of FIG. 2.

The front portion 76 of the lip 44 along the front or working aperture end 30 of the box 22 is sloped downwardly as can be seen in FIGS. 3, 4A and 4B, for example. Similarly, the front corners 78 of the side wall vertical ribs 80 projecting up from the front stacking feet 56 are also radiused or rounded, as seen in FIGS. 2 and 3. Thus, to unstack the boxes when in their stacked position, as shown in FIGS. 1 and 8, the top box is simply tilted forward and the posts and feet thereby disengaged; the tilted top box is then easily slid down the sloping front lip 76 of the lower box. The projections or posts 54 closest to the front lip 76 preferably have a more rounded configuration as shown by reference numeral 82 than those more distant. The distant ones can either be preferably rounded (FIG. 2) or can have a trapezoidal configuration (FIGS. 1, 8 and 9) as shown by reference numeral 84.

Figure 11:
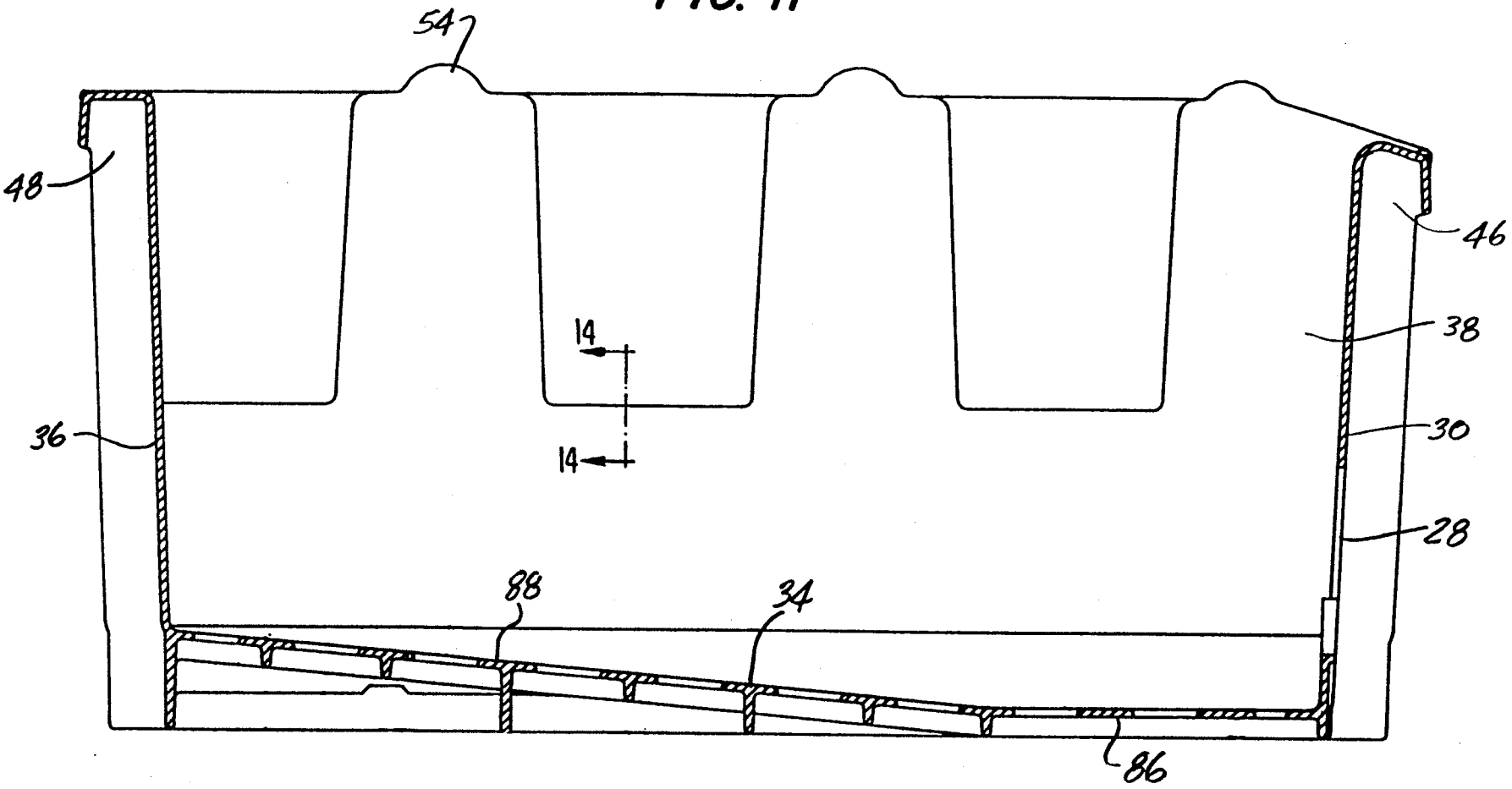
FIG. 11 is a cross-sectional view taken along line 11—11 of FIG. 6.
Figure 12:
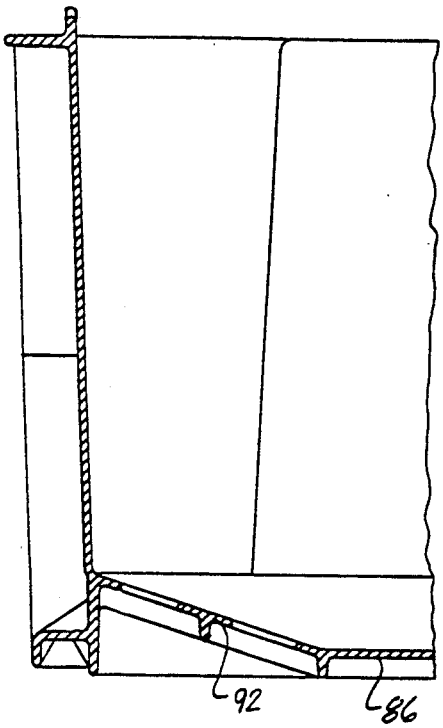
FIG. 12 is a cross-sectional view taken along line 12—12 of FIG. 6.
Figure 13:
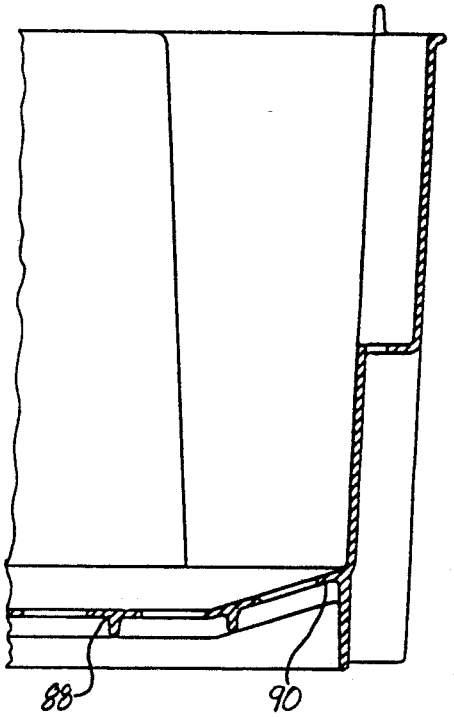
FIG. 13 is a cross-sectional view taken along line 13—13 of FIG. 6.

As seen for example in FIG. 11, the bottom floor 34 has a front portion 86 which is generally flat adjacent the front end and a larger rear portion 88 sloping down towards the front portion 86. And as seen in FIG. 6, the rear portion 88 defines a trapezoid in its top perspective view, funneling down towards the front portion 88. The portions 90, 92 of the floor 34 directly adjacent the side walls 38, 40 slope down to the other portions 86, 88 as seen in FIGS. 12 and 13, for example. The bottom floor 34 also has an open gridwork design, similar to that of known milk crates.

The design of the box 22 is such that it can be stretch wrapped or shrink wrapped when containing product (such as syrup bag 24) for sanitation, product identification or tamper evidence reasons without effecting the stacking or locking features thereof. The locking posts 54 maintain the shrink wrap (not shown) in place, and the shrink wrap does not interfere with the feet.

Unstacking loaded boxes 22 is easy with the box construction of this invention. As previously stated, the top box is tilted to unlock the stacking area or locking posts 54 and then slid in the tilted orientation over the front lip 76 of the box below. The lugs or posts 54 and mating recesses are not slid off one another. The posts are shaped to locate into the recesses and to avoid presenting any sharp corners to the syrup bag 24 as it is dropped into the box 22.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A syrup delivery system, comprising;

a first case having a pair of opposing end walls, a pair of opposing side walls, a floor structure attached to and disposed generally within said end and side walls, and an aperture in one of said end walls, said first case being positionable in a dispensing position;

a first syrup bag containing syrup and having a spigot, said first syrup bag being positionable on said floor structure within said first case for syrup dispensing when said first case is in the dispensing position;

a second case having a pair of opposing end walls, a pair of opposing side walls, a floor structure attached to and disposed generally within said second case end and side walls, and an aperture in one of said second case end walls, said second case being positionable in a dispensing position, and said second case being stackable in a stacked position on and supported by said first case;

a second syrup bag containing syrup and having a spigot, said second syrup bag being positionable on said floor structure within said second case for syrup dispensing when said second case is in the dispensing position;

wherein said floor structure of each said case slopes generally downward in the direction of each respective said end wall including said aperture; and wherein when said first and second syrup bags are disposed in said first and second cases, respectively, said spigots thereof are accessible from outside of each said case through each said aperture and each said syrup bag slopes down to each said spigot thereof.

2. The system of claim 1 wherein each said pair of end walls, pair of side walls and floor structure of each said case in the dispensing position define an uncovered interior cavity for receiving therein said first and second syrup bags, respectively.

3. The system of claim 1 wherein, when said first and second cases have said first and second syrup bags removed therefrom, said cases are further positionable in a nesting position such that said second case fits down into said first case.

4. The system of claim 3 wherein said nesting position is achieved when one said case is rotated relative to the other said case 180 degrees about a vertical axis thereof with respect to the stacked dispensing position.

5. The system of claim 3 wherein said pair of end walls and said pair of side walls of each said case define a top perimeter along an upper surface thereof and a bottom perimeter along the lower surface thereof, said top perimeter being greater than said bottom perimeter such that one said case is nestable within the other said case.

6. The system of claim 3 wherein said pair of side walls and said pair of end walls of said first and second cases, respectively, are angled inwardly from an upper surface thereof to said floor structure to allow for the nesting of said second case into said first case.

7. The system of claim 6 wherein angling of said side and end walls allows for two to one nesting of said first and second cases.

8. The system of claim 1 wherein each of said side and end walls of said first and second cases is formed to define a solid surface.

9. The system of claim 1 wherein said floor structures of said first and second cases have an open gridwork construction.

10. The system of claim 1 wherein said sloping floor structure, said pair of end walls, and said pair of side walls of said first and second cases, respectively, are integrally formed of plastic.

11. The system of claim 1 wherein said first and second cases include locking means for preventing slipping between said first and second cases when in the stacked position.

12. The system of claim 11 wherein each said case includes a top surface and a bottom surface, and said locking means includes a plurality of protuberances formed on said top surface of each said case and a plurality of recesses formed on said bottom surface of each said case.

13. The system of claim 12 wherein said plurality of protuberances interlock with said plurality of recesses when one said case is stacked on top of the other said case such that a locked position is thereby formed.

14. The system of claim 11 wherein said locking means includes locking posts on an upper surface of said first case and locking feet on a lower surface of said second case, said locking feet being configured so that corresponding said locking posts are received thereinto when said second case is stacked above said first case.

15. The system of claim 14 wherein said locking posts project upwards from an upper surface of said side walls.

16. The system of claim 15 wherein each said locking foot includes a downwardly-opening structure formed therein such that a locked condition is obtained when said locking posts are positioned in said locking feet.

17. The system of claim 16 wherein at least some of said locking posts each define upright trapezoids with rounded upper corners or upright semi-circles.

18. The system of claim 16 wherein said locking feet include bracing structures extending between an upper portion of said downwardly-opening structure and said side wall.

19. The system of claim 18 wherein said bracing structures comprise triangular members projecting perpendicularly out from said side walls and on top of said downwardly-opening structures.

20. The system of claim 1 wherein said syrup bags are separable and removable from their respective said cases, and said spigots are extendable through their respective said end wall apertures and to the exterior of their respective said cases with said syrup bags in said cases.

21. The system of claim 1 wherein said second case is positionable in a stacked dispensing position above said first case.

22. The system of claim 1 wherein each said floor structure is disposed generally perpendicular to each said end wall including said aperture.

23. The system of claim 22 wherein each said floor structure includes a front portion adjacent said end wall including said aperture, a rear portion, and two side portions, said front portion being generally flat, said rear portion defining a generally trapezoidal area funneling down towards said front portion, and said side portions sloping downwards from said adjacent side walls to said front and rear portions.

24. The system of claim 1 wherein each said aperture in said end wall includes a generally rectangular opening and an upwardly-disposed semi-circular opening communicating with a lower portion of said rectangular opening.

25. The system of claim 1 wherein said pair of end walls of each said case include a handle formation therein to facilitate lifting and carrying of each said case.

26. The system of claim 1 wherein an upper surface of said pair of end walls and said pair of side walls of each said case defines a top rim thereof.

27. The system of claim 26 wherein a front edge of said top rim slopes downwardly to facilitate the unstacking of said cases.

28. The system of claim 1 wherein said syrup comprises fountain service beverage syrup.

29. A syrup delivery system, comprising:

a first syrup bag containing syrup and having a spout;

a second syrup bag containing syrup and having a spout;

a first syrup bag box for supporting therein said first bag;

a second syrup bag box for supporting therein said second bag;

wherein said first box has a plurality of connecting side walls, a bottom floor which together with said side walls define at least in part a first box interior, and a top through which said first bag passes for insertion into and removal from said first box interior, one of said side walls having a spout through-opening at a lower portion thereof, said floor being sloped down towards said spout through-opening such that, with said first bag supported on said floor and said first bag spout extending operatively out of said spout through-opening for dispensing, drainage of syrup from said first bag out through said first bag spout is promoted;

wherein said second box has a plurality of connected side walls, a bottom floor which together with said second box side walls define at least in part a second box interior, and a top through which said second bag passes for insertion into and removal from said second box interior, one of said second box side walls having a spout through-opening at a lower portion thereof, said second box floor being sloped down towards said second box spout through-opening such that, with said second bag supported on said second box floor and said second bag spout extending operatively out of said second box spout through-opening for dispensing, drainage of syrup from said second bag out through said second bag spout is promoted;

wherein said first box with said first bag in a dispensing position in said first box interior is stackable on top of said second box with said second bag in a dispensing position in said second box interior; and wherein said side walls of said first and second boxes are configured such that said first box is nestable a distance down into said second box.

30. The delivery system of claim 29 wherein said bottom floors of said first and second cases are formed with open gridwork constructions.

31. The delivery system of claim 29 wherein, when said first bag box is stacked on top of said second bag box, said first box spout through-opening and said second box spout through-opening are aligned one above the other.

32. The delivery system of claim 31 wherein, when said first bag box is nested into said second bag box, said first box is positioned such that said first box spout through-opening is rotated by 180 degrees about a vertical axis thereof with respect to said second box spout through-opening.

33. The delivery system of claim 29 wherein said first bag box and said second bag box are in a locked position when said first bag box is stacked on top of said second bag box.

34. The delivery system of claim 33 wherein the locked position of said first bag box on top of said second bag box prevents the sliding of said first and second bag boxes relative to one another.

35. The delivery system of claim 33 wherein an upper surface of said second bag box includes a plurality of locking posts and a lower surface of said first bag box includes a plurality of locking slots such that when said first bag box is stacked on top of said second bag box each of said locking posts is received in a corresponding said locking slot to thereby obtain the locked position.

36. The delivery system of claim 35 wherein said first bag box is tipped in the direction of said first box spout through-opening in order to release said locking posts from said corresponding locking slots and thereby remove said first box from said locked position on top of said second box.

37. The delivery system of claim 35 wherein said locking posts are disposed on a top rim of said second bag box along at least two of said side walls and corresponding said locking slots are disposed adjacent an outer surface of said at least two side walls.

38. The delivery system of claim 29 further comprising hosing operatively connected to said first bag spout and through which syrup from said first syrup bag can drain.

39. The delivery system of claim 38 wherein said hosing is connected in series to said second bag spout.

40. The system of claim 29 wherein said syrup comprises fountain service beverage syrup.

41. A syrup delivery system, comprising:

a first case having a pair of opposing end walls, a pair of opposing side walls, a floor structure attached to and disposed generally within said end and side walls, and an aperture in one of said end walls, said first case being positionable in a dispensing position;

a first syrup bag containing syrup and having a spigot, said first syrup bag being positionable on said floor structure within said first case for syrup dispensing when said first case is in the dispensing position;

a second case having a pair of opposing end walls, a pair of opposing side walls, a floor structure attached to and disposed generally within said second case end and side walls, and an aperture in one of said second case end walls, said second case positionable in a dispensing position, and said second case being stackable in a stacked position on and supported by said first case;

a second syrup bag containing syrup and having a spigot, said second syrup bag being positionable on said floor structure within said second case for syrup dispensing when said second case is in the dispensing position;

wherein said floor structures of each said case slope generally downward in the direction of each respective said end wall which includes said apertures;

wherein when said first and second syrup bags are disposed in said first and second cases, respectively, said spigots thereof are accessible from outside of each said case through each said aperture and each said syrup bag slopes down to each said spigot thereof;

wherein said first case has a first case top surface and said second case has a second case bottom surface;

a projection formed on one of said first case top surface or said second case bottom surface; and a recess formed on the other of said first case top surface or said second case bottom surface, said recess corresponding to said projection and being configured and constructed to mate with said projection when said second case is in the stacked position supported on said first case and to thereby to block free sliding of said first case bottom surface on and along said second case top surface.

42. The system of claim 41 wherein said recess includes a locking foot on said second case bottom surface, said locking foot including a downwardly-opening structure and bracing structure extending between an upper portion of said downwardly-opening structure and one of said second case side walls.

43. The system of claim 42 wherein said projection comprises a locking post on said first case top surface.

44. The system of claim 41 wherein said second case bottom surface comprises a bottom surface of at least one of said second case side walls.

45. The system of claim 41 wherein said floor structures of both said first and second cases have a plurality of drainage through-openings.

46. The system of claim 41 wherein said projection is integrally formed on said first case top surface.

47. The system of claim 41 wherein said recess is integrally formed on said second case bottom surface.

48. The system of claim 41 wherein said first case top surface comprises a top surface of one said first case side walls.

49. The system of claim 41 wherein each said sloping floor structure slopes down towards a longitudinal center line extending between said end walls.

50. The system of claim 41 wherein each said pair of end walls, pair of side walls and floor structure of each said case when in the dispensing position defines an uncovered interior cavity for receiving therein said first and second syrup bags, respectively.

51. The system of claim 41 wherein, when said first and second cases have said first and second syrup bags removed therefrom, said cases are further positionable in a relative nesting position wherein said second case is fitted down into said first case.

52. The system of claim 51 wherein the nesting position is achieved when one said case is rotated relative to the other said case 180 degrees about a vertical axis thereof with respect to the stacked dispensing position.

53. The system of claim 51 wherein said pair of end walls and said pair of side walls of each said case define a top perimeter along an upper surface thereof and a bottom perimeter along a lower surface thereof, said top perimeter being greater than said bottom perimeter such that one said case is nestable within the other said case.

54. The system of claim 51 wherein said pair of side walls and said pair of end walls of said first and second cases, respectively, are angled inwardly from an upper surface thereof to said floor structure to provide for the relative nesting position.

55. The system of claim 54 wherein angling of said side and end walls of both said cases allows for two-to-one nesting of said first and second cases.

56. The system of claim 51 wherein each of said side and end walls of said first and second cases comprises a solid surface from top to bottom and end to end.

57. The system of claim 51 wherein said floor structures of said first and second cases both have open gridwork constructions.

58. The system of claim 51 wherein said sloping floor structure, said pair of end walls, and said pair of side walls of said first and second cases, respectively, are integrally formed together of plastic.

59. The system of claim 41 wherein said first and second syrup bags are separable and removable from their respective said cases, and said spigots are extendable through their respective said end wall apertures and to the exterior of their respective said cases with said syrup bags in said cases.

60. The system of claim 41 wherein each said floor structure includes a front portion adjacent said end wall including said aperture, a rear portion, and two side portions, said front portion being generally flat, said rear portion defining a generally trapezoidal area funneling down towards said front portion, and said side portions sloping downwards from said adjacent side walls to said front and rear portions.

61. The system of claim 41 wherein each said aperture in said end wall includes a generally rectangular opening and an upwardly-disposed semi-circular opening communicating with a lower portion of said rectangular opening.

62. The system of claim 41 wherein said pair of end walls of each said case include a handle formed therein to facilitate lifting and carrying of each said case.

63. The system of claim 41 wherein upper surfaces of said pair of end walls and said pair of side walls of each said case define a top rim thereof.

64. The system of claim 63 wherein a front edge of each said top rim slopes outwardly and downwardly to facilitate the unstacking of said cases.

65. The system of claim 41 wherein said syrup comprises fountain service beverage syrup.

* * * * *